US005507119A

United States Patent [19]

Sumiya et al.

[11] Patent Number: 5,507,119

[45] Date of Patent: Apr. 16, 1996

[54] AUTOMATIC SLIDE DOOR

[75] Inventors: Kazuhiro Sumiya, Hekinan; Ryoichi Fukumoto, Nagoya; Yasuaki Suzuki, Kariya, all of Japan

[73] Assignee: Aisin Seiki Kabushiki Kaisha, Kariya, Japan

[21] Appl. No.: 298,779

[22] Filed: Aug. 31, 1994

[30] Foreign Application Priority Data

Sep. 6, 1993 [JP] Japan ..... 5-245998

[51] Int. Cl.[6] ..... E05D 15/10

[52] U.S. Cl. ..... 49/218; 49/360

[58] Field of Search ..... 49/360, 209, 216, 49/218

[56] References Cited

U.S. PATENT DOCUMENTS

| | | | |
|---|---|---|---|
| 3,935,674 | 2/1976 | Williams et al. | 49/216 X |
| 4,462,185 | 7/1984 | Shibuki et al. | 49/360 X |
| 4,932,715 | 6/1990 | Kramer | 49/360 X |
| 4,945,677 | 8/1990 | Kramer | 49/218 X |
| 5,140,770 | 8/1992 | Morvan | 49/218 X |

FOREIGN PATENT DOCUMENTS

| | | | |
|---|---|---|---|
| 2546507 | 4/1977 | Germany | 49/216 |
| 2624296 | 12/1977 | Germany | 49/216 |
| 4-21703 | 5/1992 | Japan . | |

*Primary Examiner*—Philip C. Kannan
*Attorney, Agent, or Firm*—Burns, Doane, Swecker & Mathis

[57] ABSTRACT

Automatic slide door mechanism includes a slide rail secured to a slide door of a vehicle and which is extended in the fore-aft-direction of the vehicle, a slide rail guide holding the slide rail and held by an arm rotatably coupled to a main vehicle body, swing driving actuator for rotating the arm towards inside or outside of the vehicle, and slide driving actuator separate from the swing driving actuator, the slide driving actuator being held by the slide rail guide and adapted for actuating the slide door and the slide rail in the fore-and-aft direction of the vehicle. This assures smooth and prompt operation during movement of the slide door in the fore-and-aft direction of the vehicle and a sufficiently large torque during movement of the slide door towards inside or outside.

21 Claims, 13 Drawing Sheets

AUTOMATIC SLIDE DOOR

FIELD OF THE INVENTION

This invention relates to a slide type door for a vehicle and, more particularly, to an automatic slide door which may be opened and closed by driving actuator.

BACKGROUND

An example of conventional slide doors of this type is a slide door device for a vehicle as described in JP Utility Model Kokoku Publication No. 4-21703 (1992). FIGS. 14 to 16 show a slide door device disclosed in the JP UM Kokoku Publication. Thus, FIGS. 14 to 16 show an opened state of the slide door, a closed state of the slide door and a cross-section taken along a line 16—16 of FIG. 14, respectively.

In FIGS. 14 to 16, a mounting bracket 21 is mounted on a main vehicle body. Each of the link plates 23A, 23B of a parallel link 2 has its proximal end pivotally mounted on the mounting bracket 21 and has its distal end 231, 232 pivotally supported on a holding member 3. In FIG. 16, the link plate 23A is provided with a driving motor 26. The torque of the driving motor 26 is transmitted to a pinion 25 via a gear box 27 and a shaft 251.

In FIG. 16, a slide rail 1 is made up of a guide rail 12, an extension 14 and a main member 15, and is secured to a slide door S at the extension 14. In FIG. 14, a rack 13 having rack teeth 13*a* is provided within the guide rail 12, and has its rear end 131 bent at a larger angle into the inside of the main member 19.

The rack teeth 13*a* are engaged with a pinion 25. Rotation of the pinion 25 imparts a driving force to the slide rail 1 being in unison with the rack 13 and the slide door S, such that the slide door S is linearly movable in the fore-and-aft direction (left-and rightward direction in FIG. 14), basically along a straight section of the rack 13.

For closing the slide door S, it is moved forwardly (towards the right in FIG. 14). When a curved rear end 131 of the rack 13 reaches the pinion 25, forward movement of the slide door S ceases. The curved rear end 131 then travels along its curve by operation of a pinion 25, while the link plate 23A is rotated about a distal end 231 forming the proximal end of the link plate 23A, as a result of which the parallel link 2 in its entirety is swung towards the inner side of the vehicle, with the slide door S being moved towards the inner side in a direction at right angles to a pivotal (link) shaft of the main member (as seen in FIG. 14) and closed. FIG. 15 shows such closed state of the slide door S.

DISCUSSION OF THE RELATED ART

According to eager investigation of the inventors of the present invention the following problems were found in the related art.

With the above-described conventional slide door device, a sole driving actuator is employed and the driving force of the driving actuator is transmitted to a rack via a pinion gear. The slide door is moved towards the inside and outside and in the fore-and-aft direction by the movement of the rack having one bent end relative to the pinion gear.

However, when the slide door is moved in the fore-and-aft direction, it needs to be moved at some elevated speed in order to shorten the door opening and closing time. On the other hand, a larger torque is required and hence the pinion gear has to be decelerated in order to cause the movement of the slide door towards the inside or outside, thus it is difficult for the sole driving actuator to control the movement time and the driving force for the slide door in the respective direction.

That is, if the rotation of the driving motor is set so as to conform to the movement of the slide door in the fore-and-aft direction, torque shortage is incurred when the slide door is to be moved towards the inner side or the outer side. Conversely, if the rotation of the driving motor is set so as to conform to the movement of the slide door towards the inside or outside, speed of movement in the fore-and-aft direction is retarded. If a driving mechanism having a uniform speed of movement is employed as the driving actuator, and an electrical control system needs to be employed in order to eliminate the deficiency, resulting in the complicated control system.

SUMMARY OF THE DISCLOSURE

It is therefore an object of the present invention to provide a novel automatic slide door of a simplified structure which is capable of performing a smooth and prompt operation and developing a sufficiently large torque when moving the slide door towards the inside or outside.

Further objects will become apparent in the entire disclosure and claims.

For accomplishing the above object, the present invention generally provides a driving actuator for moving a slide door towards the inside or outside, and another driving actuator, different from the firstly-stated driving actuator, for moving the slide door in the fore-and-aft direction. In addition, the present invention controls the changeover timing of the two driving actuators in order to effect smooth and prompt sliding and positive closure, thereby controlling optimum driving timing of the respective driving actuators and the required driving power.

The present invention provides an automatic slide door comprising (a) a slide rail secured to a slide door of a vehicle and extended in a fore-and-aft direction of the vehicle, (b) a slide rail guide holding the slide rail and held by an arm rotatably coupled to a main body of the vehicle, (c) a swing driving actuator for rotating the arm towards inside or outside of the vehicle, and (d) a slide driving actuator separate from the swing driving actuator, wherein the slide driving actuator is held by the slide rail guide and is adapted for actuating the slide door and the slide rail in the fore-and-aft direction of the vehicle. (Aspect 1, may be referred to as a "basic structure", hereinafter)

Further, according to the present invention, the swing driving actuator is adapted to be operative between a bracket rotatably coupling the arm to the vehicle and the arm pivotally supported on the brackets. The swing driving actuator causes swinging movement of the arm, the slide rail being adapted to be moved only in the fore-and-aft direction with respect to the slide rail guide. (Aspect 2)

The swing driving actuator and the slide driving actuator include a relative position detector operated between the slide rail and the slide rail guide, and are driven by an output signal of the relative position detector. (Aspect 3)

According to the present invention, there is also provided a control unit for simultaneously actuating the swing driving actuator and the slide driving actuator for a pre-set time responsive to an output signal of the relative position detector. (Aspect 4)

More specifically, the automatic slide door of the present invention comprises (a) a slide rail secured to a slide door of a vehicle and extended in a fore-and-aft direction of the vehicle, (b) a slide rail guide holding the slide rail and held by an arm rotatably coupled to a main body of the vehicle, (c) a swing driving actuator for rotating the arm towards inside or outside of the vehicle, (d) a slide driving actuator held by the slide rail guide and adapted for actuating the slide door and the slide rail in the fore-and-aft direction of the vehicle, (e) a relative position detector including a switch for selecting a changeover position at which switching is to be made between rotation of the arm and the actuation of the slide rail, and a cam mechanism for holding an operating state of the switch, and (f) a control unit controlling the operation of the swing driving actuator and the slide driving actuator responsive to an output detection signal of the relative position detector, the control unit causing simultaneous operation of the swing driving actuator and the slide driving actuator for a pre-set-time on detection of the output detection signal. (Aspect 5)

The following basic function and operation are carried out by the present invention.

According to the basic structure of the present invention, an optimum driving force and an optimum operating time may be independently set in connection with the movement in the fore-and-aft direction and rotation towards inside or outside of the slide door, whereby a basic structure may be achieved in which prompt and smooth movement in the fore-and-aft direction and positive closure by the movement under a larger torque in the direction towards inside or outside during the final stage of door closure may be realized together.

At the time of changeover from the movement in the fore-and-aft direction of the door and the rotation towards inside or outside on the basis of the above-described basic structure, the two driving actuators are actuated simultaneously (i.e., overlapping each other) for a pre-set time duration, in order to effect smooth reliable transition between the operating period in the fore-and-aft direction at an elevated operating speed and the operating period in the direction towards inside or outside of the vehicle at a retarded operating speed. (Aspects 4 and 5)

According to the basic structure of the present invention, as shown in the schematic skeletonic view of FIG. 13, the basic principle for smooth and positive opening and closure of the automatic slide door is given by an extremely simple structure, so that the constituent elements may be selectively combined depending on the intended use on the basis of the above principle.

That is, it suffices if the bracket 1 is such as can pivotally mount arms and can be mounted on a vehicle. A swing driving actuator 11A is interposed between the arm and the bracket 11. In addition to the screw rod and nut type driving actuator, shown herein, a pressure medium actuating type swing driving actuator 11A, such as a pneumatic or hydraulic driving actuator, or other mechanical swing driving mechanism, may also be employed. In any case, the swing driving actuator is preferably controllable directly or indirectly by electrical signals.

Although the arm of the parallel arm type as shown in the Figures is preferred, the arm may also be other than linear or parallel, provided that the door can be thereby securely retained and held movably towards the inside or the outside of the vehicle.

The slide rail and the slide rail guide are not limited to the shape shown, provided that the slide rail and the slide rail guide are slidable relative to each other and of retentive force and toughness sufficient to hold the door. The same may be said of the rail orientation and the direction of engagement between the slide rail and the slide rail guide. The following embodiments meet these points and are satisfactory in assembling and stability.

The relative position detector includes slide rail position detection and arm angle detection. Although a combination of a cam and the limit switch as shown is simplest in structure, position sensors, such as optical, photo-electric or electro-magnetic position sensors, may be used alone or in combination. So-called proximity switches may also be employed.

The slide driving actuator of the roll type as shown which is pressure contacted to a slide rail surface, is simplest in structure. However, it is also possible to employ a slide driving actuator of any known type, such as a rack-and-pinion type or an endless belt type (i.e., wire or chain type) as a slide driving actuator.

A safety stopper for the slide driving actuator may also be disposed, which is preferred.

According to the structures of aspects 2 and 3, there may be realized embodiments meeting the objects by a simplified structure based upon the basic structure, respectively.

SUMMARY OF THE PREFERRED EMBODIMENTS

The preferred embodiments will be outlined hereinbelow generally, the relative position detector includes a switch for detecting a changeover position at which switching is to be made between rotation of said arm and the actuator of said slide rail, and includes a cam arrangement for holding an operating state of said switch.

The cam arrangement comprises a (first) lever (or engagement member) which is engageable with a cam disposed at a distal end of the arm to latch the open state of the door at a predetermined angle, the first lever being retained at a predetermined position defining the open state of the door by means of a spring force.

The lever is retained in the predetermined position defining the open state of the door by a further (second) lever which is urged by a spring against unlatching the latching to the open state of the door.

The second lever is associated with the switch for detecting a changeover position.

At least one of the first and second levers is unlatched by an actuating member disposed on the slide rail so as to bring the arm rotatable relative to the slide rail guide.

The unlatching is made when the slide rail is slid to its end position ready for rotating the arm for closing the door.

Thus the switch serves as a relative position detector, and the switch is switched over upon abutment of the actuating member disposed on the slide rail.

The second lever is an L-shaped lever retained swingable about a rotation center of the lever, with its first leg (or end) serving to abut with the first lever and with its second leg (or end) serving to engage a cam portion (surface) of the actuating member disposed on the slide rail so as to retain the angular position of the slide rail relative to the slide rail guide during the rotation of the arm for closing and opening the door.

The second leg has a pin protruding from the second leg, said pin engaging a back-slope of the cam portion of the actuating member so as to retain the cam at the engaged position, when the actuating member urges the L-shaped lever to swing about its rotation center. The L-shaped lever is urged by a spring toward a direction for retaining the first lever to a locking position against the cam of the arm.

The swing driving actuator comprises a screw rod assembly operating between the arm and a bracket to be secured to the main body of the vehicle for rotatably supporting said arm.

More preferably, the slide rail driving actuator comprises a motor-driven roll driving the slide rail.

The simultaneous operation of the swing and slide driving actuator is controlled by the switch acting on a lever which serves to retain the angular position between said arm and the door.

The switch acts on the second lever which is urged by a spring toward the open state of the door, the second lever retaining the first lever which is engageable with the cam disposed on the arm.

The pre-set time of simultaneous operation may be initiated with a delay time after the detection of the output signal of the relative position detector.

In summary, the present invention provides the following meritorious effects.

According to the basic structure of the present invention, separate independent driving actuators are provided which take charge of (i) movement in the fore-and-aft direction and (ii) rotation towards the inside or outside of the slide door, whereby an optimum driving force and an optimum moving time may be set such that an increased speed and a retarded speed may be realized for the movement in the fore-and-aft direction and for the movement towards the inside or the outside, respectively, with a consequence that premises for time reduction in slide door movement are satisfied. (Aspect 1)

In addition, by providing an overlap period at the time of switching between the movement in the fore-and-aft direction and that towards the inside or outside of the vehicle, smooth and secured transition of the changeover operations is achieved without the necessity of strictly setting the changeover position by the changeover position detection switch. (Aspects 4 and 5)

With the construction of the Aspects 2 and 3, the present invention may be implemented by a simplified structure on the basis of the basic structure of the present invention. The relative position detector can be simpler in structure if it is comprised of a limit switch and a cam in combination therewith.

EXPLANATION OF NUMERALS

| | |
|---|---|
| 1 . . . bracket; | 2, 2a . . . swing arms (arms); |
| 4 . . . slide rail guide; | 6 . . . nut; |
| 7 . . . ball screw rod; | 11A . . . swing driving actuator; |
| 11 . . . swing motor; | 13 . . . gear box; |
| 14A . . . slide driving actuator; | |
| 14 . . . slide motor; | 15 . . . roll housing; |
| 18 . . . slide rail; | 19 . . . roll; |
| 21 . . . slide door; | |
| 24 . . . engagement member (first lever); | |
| 25 . . . lever; 25c . . . first leg; | 25b . . . second leg; |
| 26 . . . actuating member (second cam); | |
| 26a . . . cam portion (surface); | |
| 26a' . . . back slope | |
| 27A . . . relative position detector (23a, 24, 24a, 25, 26, 27); | |
| 27 . . . changeover position detection switch (limit switch) | |

DESCRIPTION OF THE PREFERRED EMBODIMENTS

Preferred embodiments of the present invention will now be explained hereinbelow with reference to the drawings.

Figure 1:
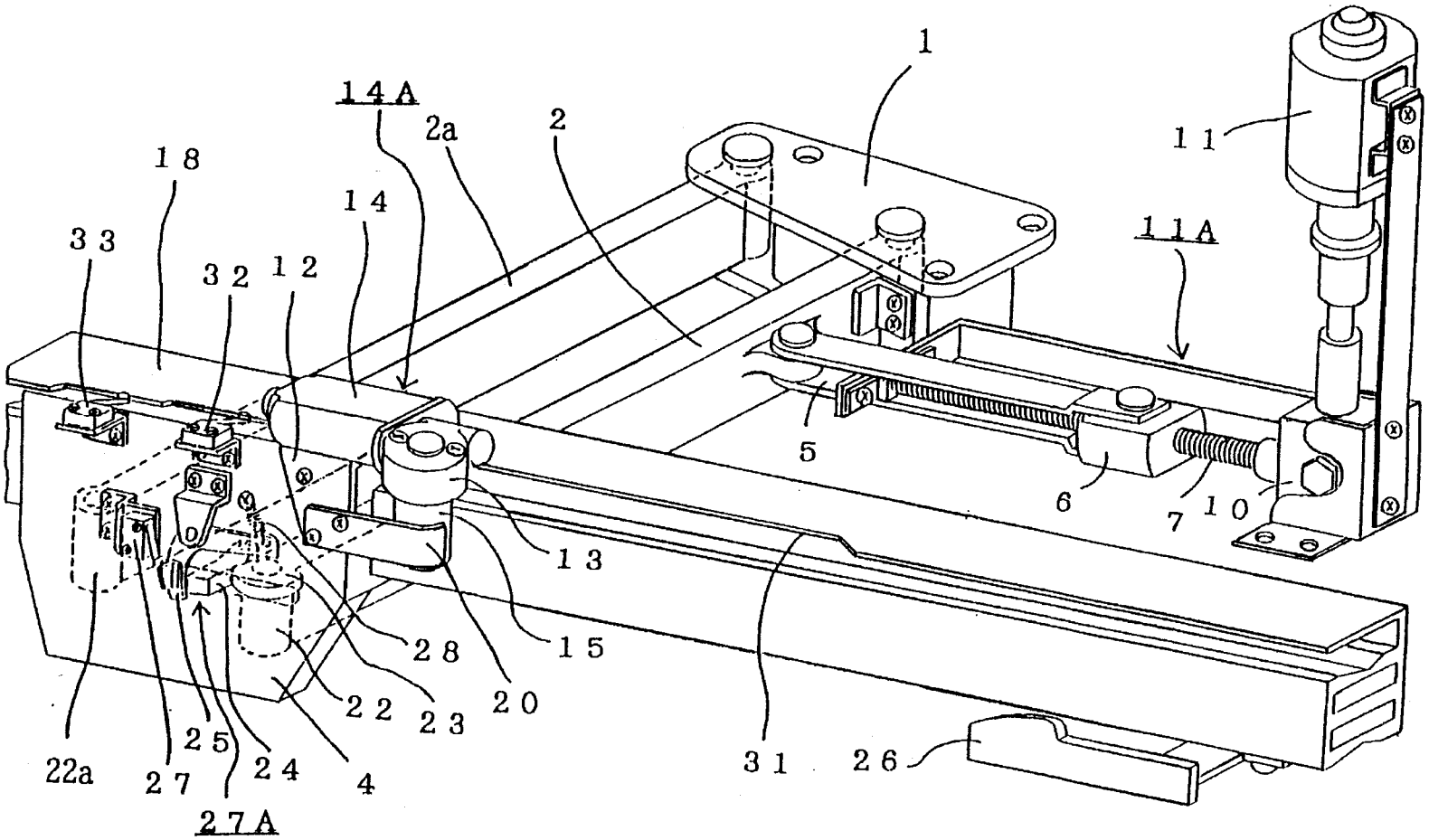
FIG. 1 is a perspective view showing an arrangement of an automatic slide door according to the present invention.

FIG. 1 shows a construction of an automatic slide door according to an embodiment of the present invention.

A bracket 1 is secured to a main vehicle body. Each of two swing arms 2, 2*a* has its proximal end pivotally mounted on a bracket 1 and has its distal end pivotally mounted on a slide rail guide 4.

Figure 2:
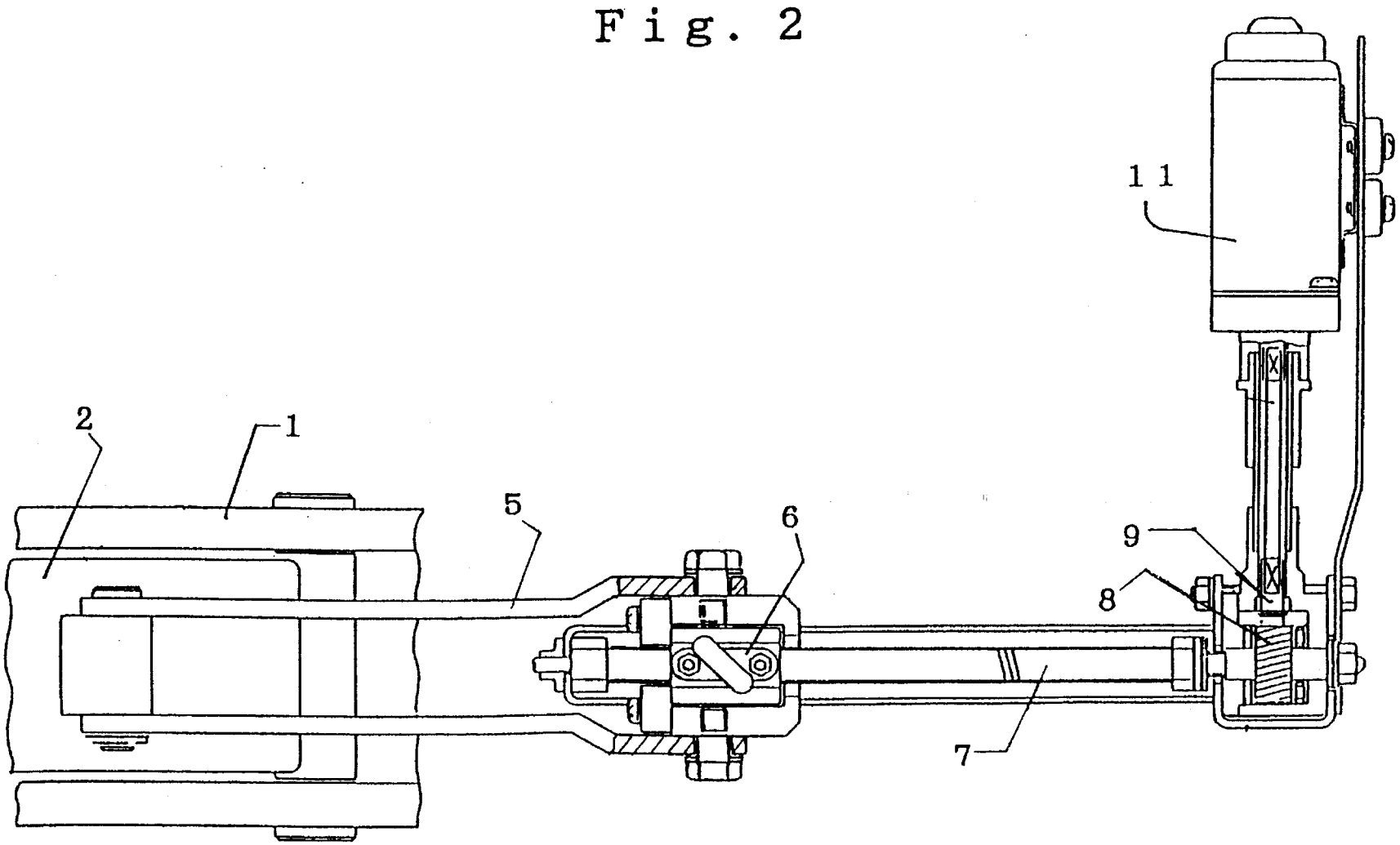
FIG. 2 is a plan view, shown partially in cross-section, and showing a structure of a swing driving actuator.

FIG. 2 shows a mechanism of a swing driving actuator 11A. In this figure a connecting lever 5 has its one end pivotally mounted to a mid portion of the swing arm 2 and thrusts the swing arm 2 for rotating the swing arm 2 about its proximal end as a center of rotation. A nut 6 is secured to the other end of the connecting lever 5 and a ball screw rod 7 is passed through and threadedly engaged to the nut 6.

The ball screw rod 7 is rotationally connected to a motor for swing action (referred to as swing motor) 11 via a gear box 10 inclusive of a worm wheel 8 and a worm shaft 9. The swing motor 11 and the gear box 10 are secured to the main vehicle body. The ball screw 7 is rotated by rotation of the swing motor 11, whereby the nut 6 is moved in the axial direction of the ball screw 7 to push or pull the swing arm 2 to thereby cause its rotation.

Figure 3:
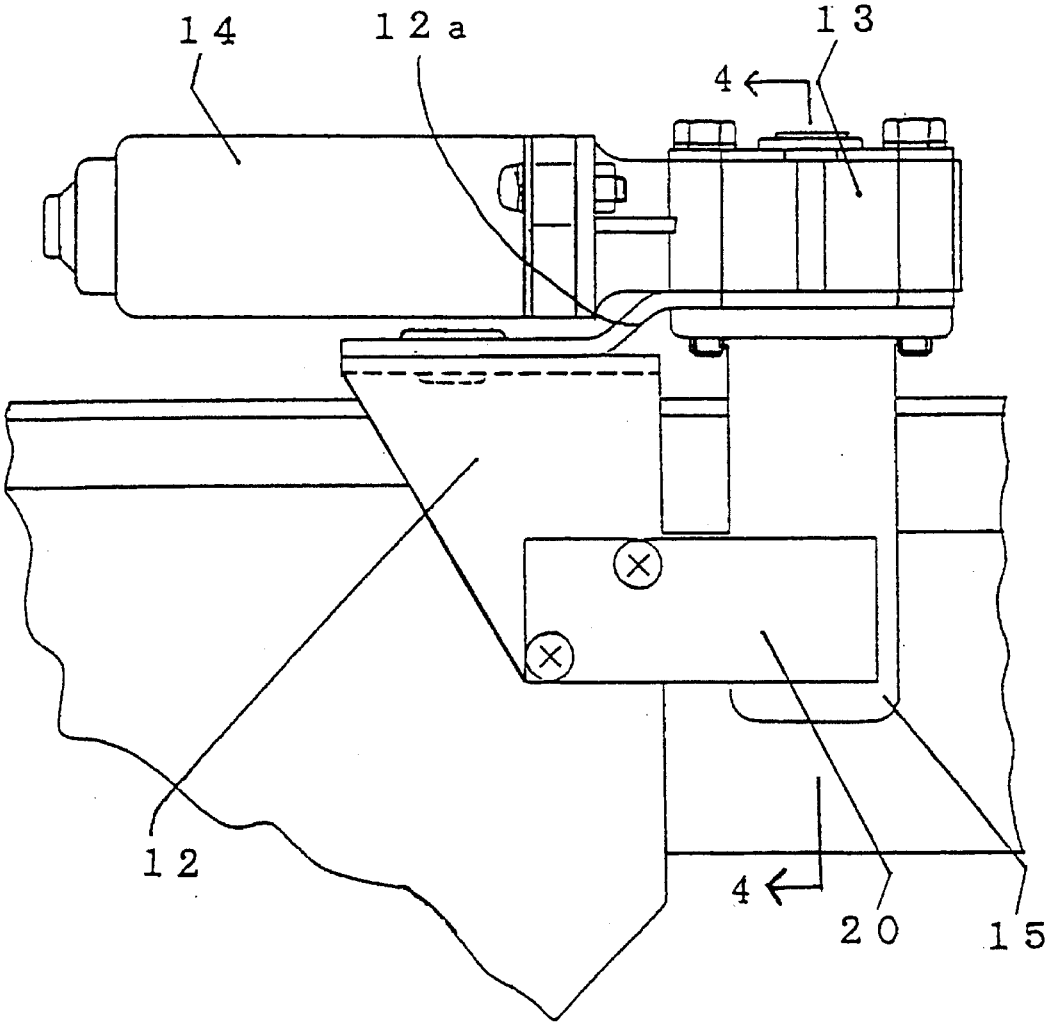
FIG. 3 is a plan view showing a structure of a slide driving actuator.
Figure 4:
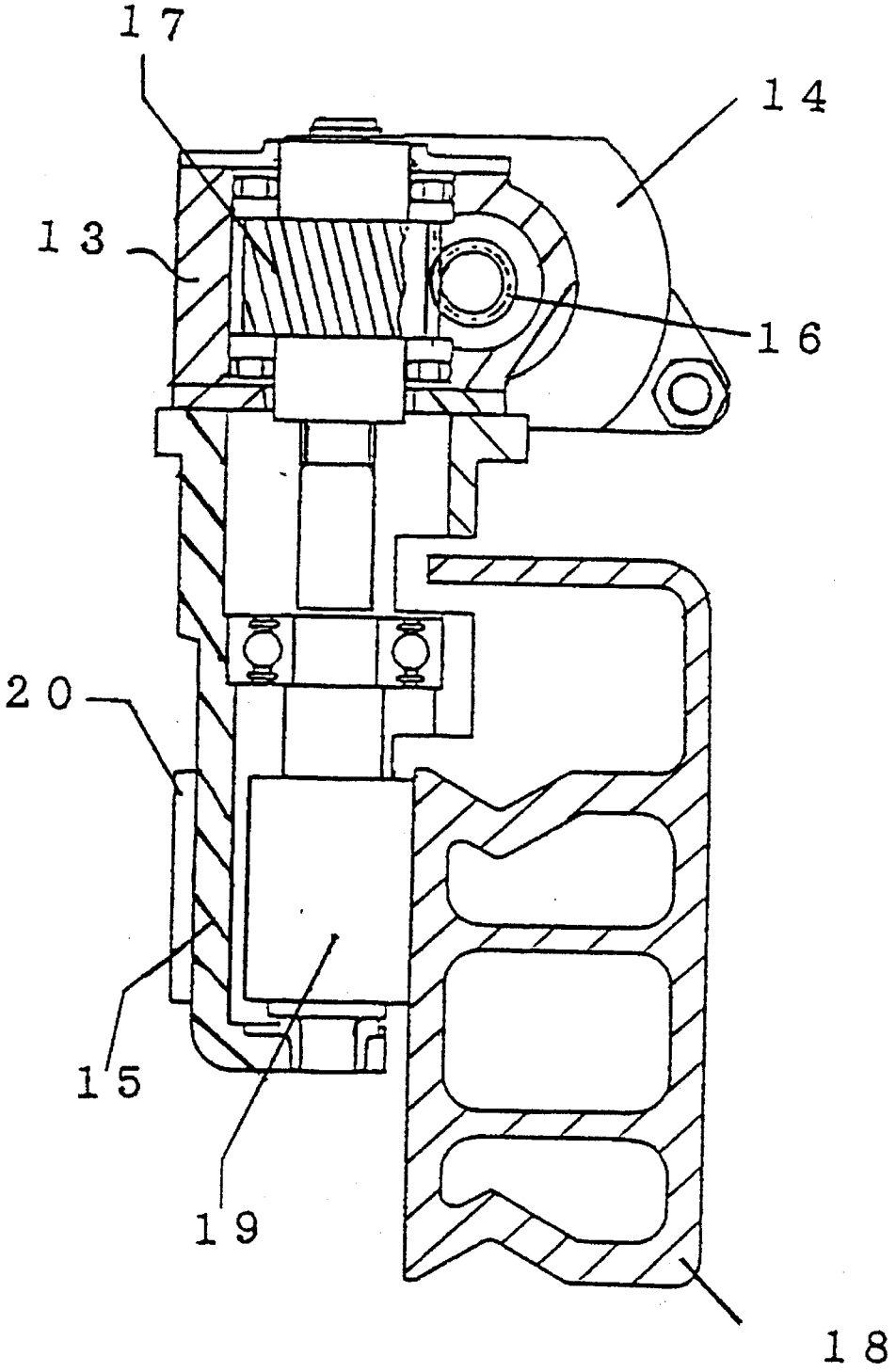
FIG. 4 is a cross-sectional view taken along line 4—4 of FIG. 3.

FIGS. 3 and 4 show a mechanism of the slide driving actuator 14A. A bracket 12 is secured to the outer side of the slide rail guide 4. To a gear box 13 secured via a swing bracket 12*a* to the bracket 12 are secured a motor for sliding (referred to as slide motor) 14 and a roll housing 19. The rotary force of the slide motor 14 is transmitted via a worm 16 and a worm wheel 17 within the gear box 13 to a roll 19 which is in press/friction-contact with the slide rail 18.

The pressing force applied to the roll 19 is produced by a leaf spring 20 urging the roll housing 15 towards the slide rail 18. When the roll 19 is rotated by the slide motor 14, the slide rail 18 is moved in the fore-and-aft direction (left-and right direction in FIG. 1).

Figure 5:
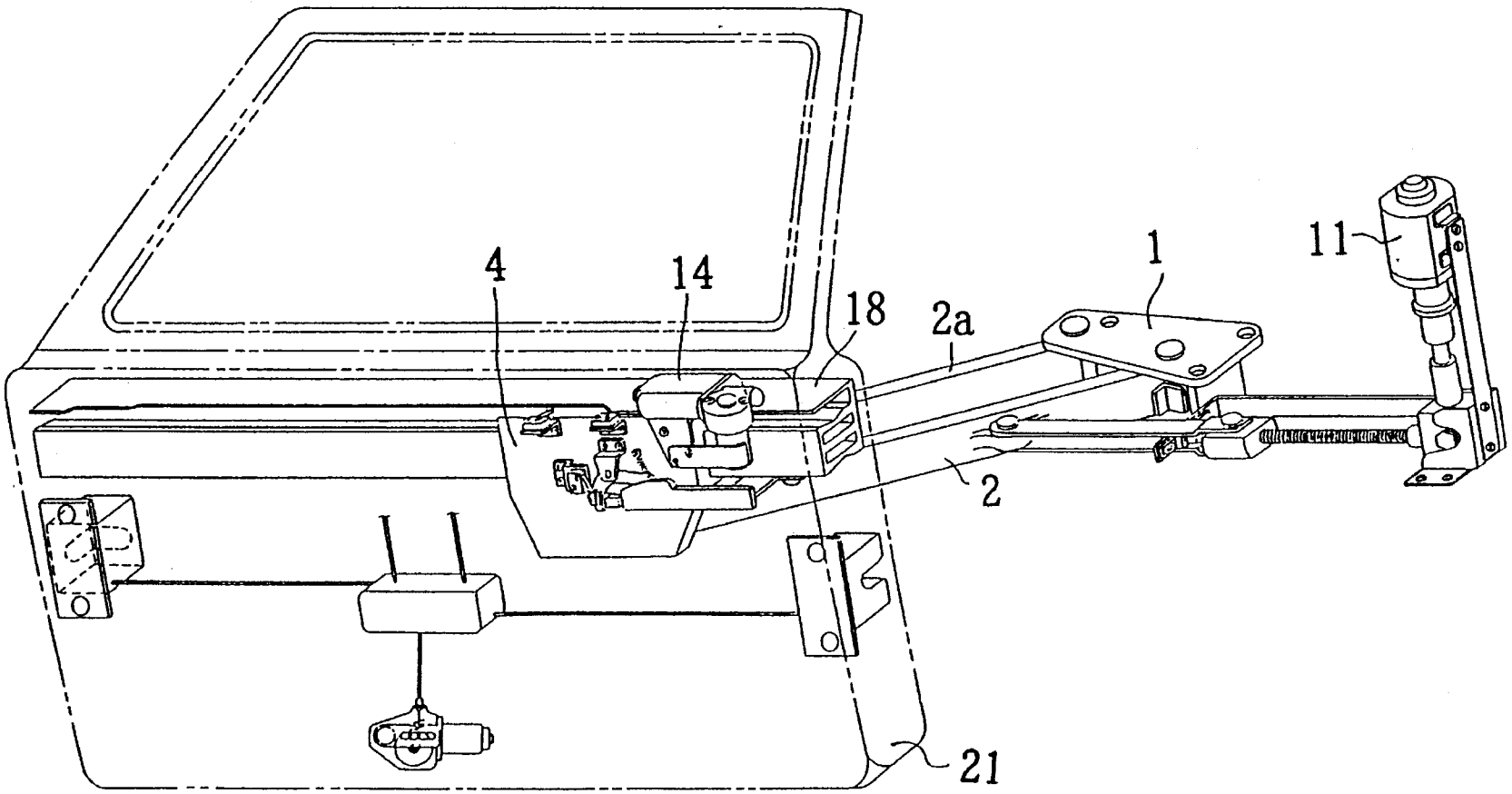
FIG. 5 is a perspective view showing a state of engagement of an automatic slide door mechanism and a slide door.

FIG. 5 shows a state of engagement of the slide door mechanism with the door, in which the slide rail 18 and a slide door 21 fast with the slide rail 18 are moved in the fore-and-aft direction by the rotation of the slide motor 14.

In FIG. 1, each pair of upper and lower rolls, not shown, are arranged on the forward and rear ends of the slide rail 18, respectively, on the inner side of the slide rail guide 4 for supporting the slide rail 18 by the pairs of upper and lower rolls. Each of the swing arms 2, 2*a* has its distal end 22, 22*a* pivotally supported by the inner side of the slide rail guide 4. Thus the swing arms 2, 2*a* hold the slide rail 18 via the slide rail guide 4.

Figure 6:
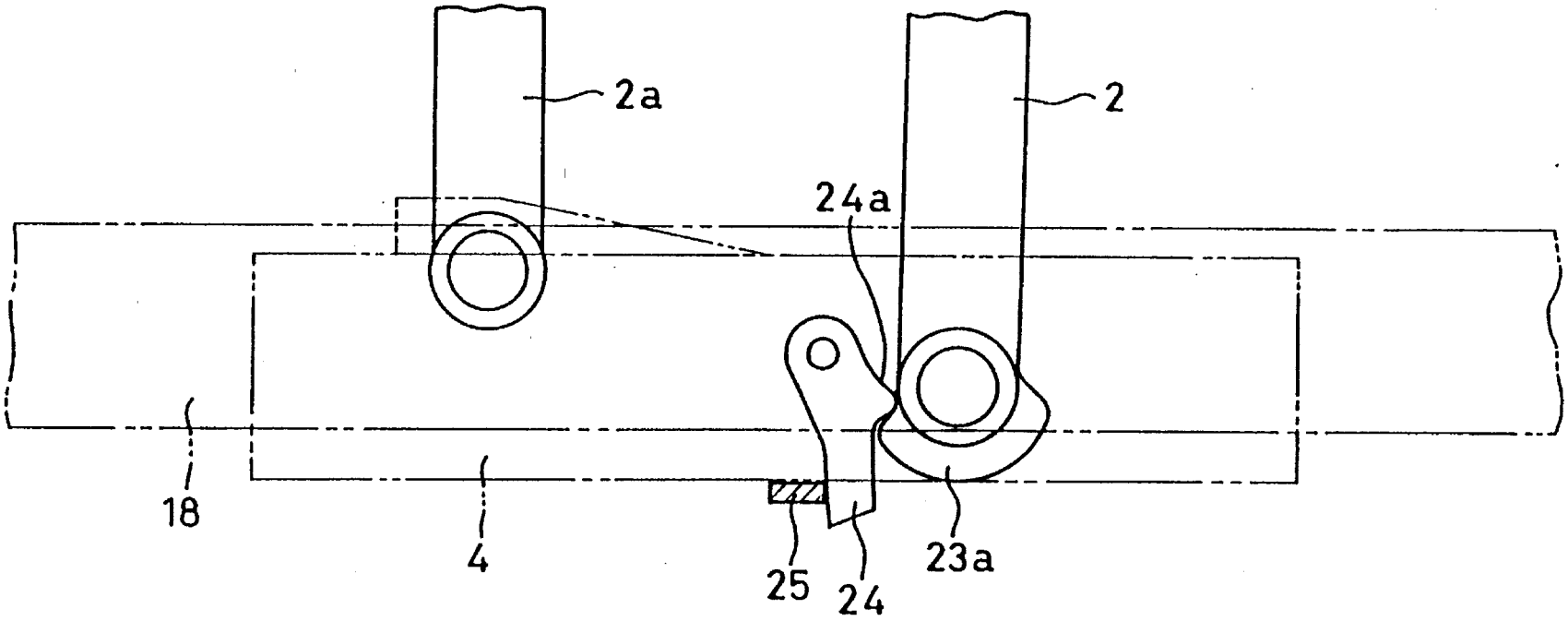
FIG. 6 is a schematic view showing engagement states between relevant components during movement of the slide door in the fore-and-aft direction.
Figure 7:
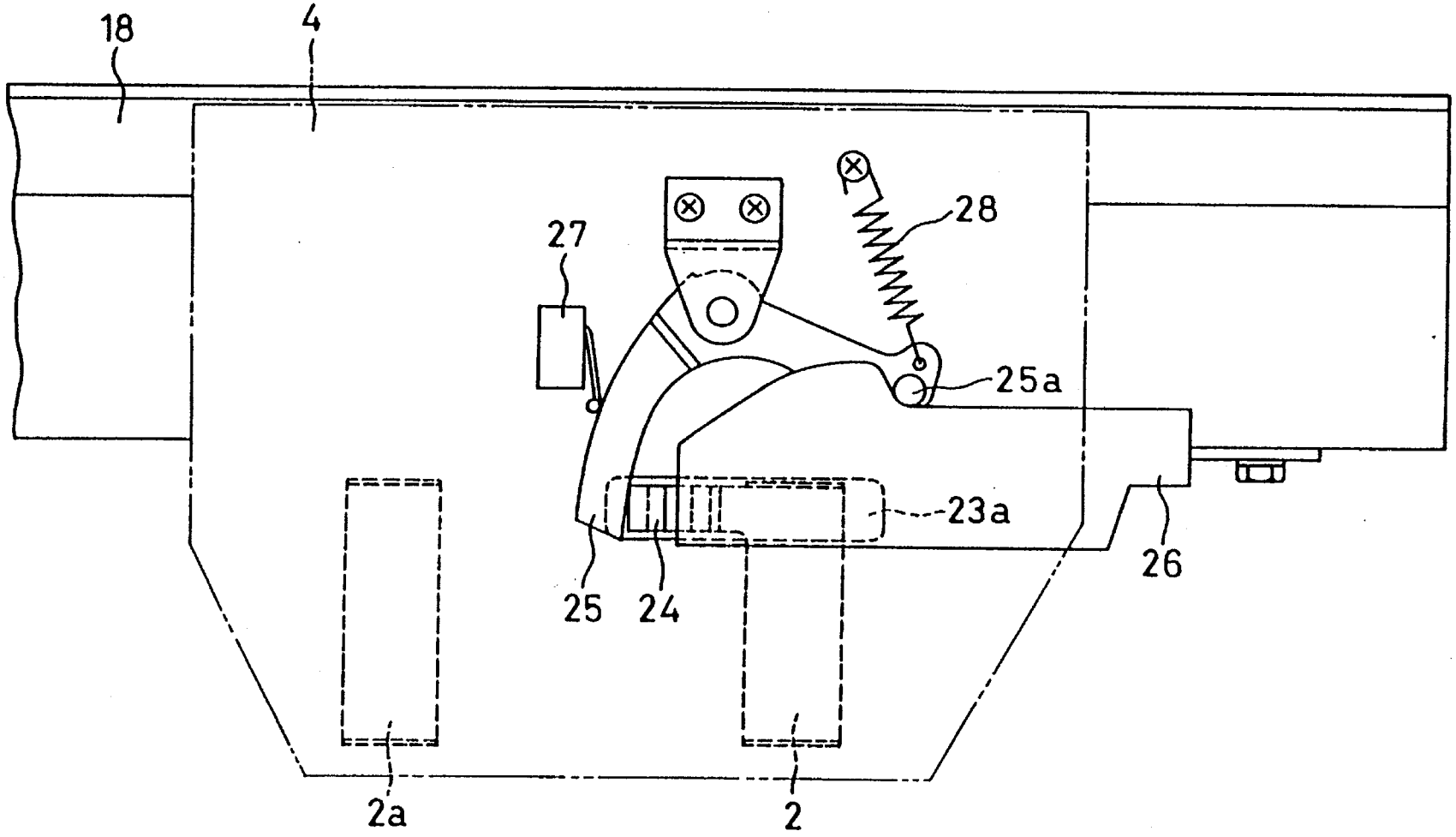
FIG. 7 is a schematic view showing engagement states between relevant components when the slide door is enabled to be rotated towards inside or outside.

In FIG. 1, the upper surface 23 of a distal end 22 of the swing arm 2 has its peripheral edge formed with a cam and engaged with an L-shaped lever 25 via an engagement member 24 (refer to FIG. 6, too). As shown in FIG. 7 in detail, the L-shaped lever 25 has its mid portion pivotally mounted at 25*d* and has its inner side of distal end 25*b* abutting against the engagement member 24 under bias of a spring 28 retained at an opposite end 25*c* of the lever 25. A changeover position detection switch 27 abuts against the outer side of the lever end 25*b*.

FIG. 6 shows an engaged state of the cam portion of the swing arm when the slide door is moved in the fore-and-aft direction. The engagement member 24 has its cam portion 24*a* engaged with a cam portion 23*a* of the swing arm 2, while an engagement force which inhibits inward rotation of the swing arm 2 is maintained when the slide rail 18 and the slide door 21 are moved in the fore-and-aft direction. This engagement force is given by retaining the engagement member (lever) 24 at a predetermined position applying the biasing force of the spring 28 which acts on the opposite end 25*c* of the lever 25 to be exerted to the distal end 25*b* thereof.

In the following description, the operation of the slide door 21 will be explained. FIG. 1 shows an opened state of the slide door 21. If the slide rail 18 is moved from this state towards the left in FIG. 1 under the driving force of the slide motor 14, the slide door 21 is moved in the closing direction. An actuating member 26 provided on the right-side end of the slide rail 18 in FIG. 1 is caused to bear on the engagement member 24 within the slide rail guide 4 in order to thrust the lever 25 towards the left against the bias of a spring 28.

When the actuating member 26 abuts against and thrusts engagement member 24, a changeover position detection switch 27, comprised of a limit switch constituting a portion of relative position detector 27A is also thrust for switching the changeover position detection switch 27 from an ON state to an OFF state. At this time, the cam portion 24*a* of the engagement member 24 is disengaged from the cam portion 23*a* of the swing arm 2, whereby the swing arm 2 becomes rotatable. In addition, a cam portion 26*a* of the actuating member 26 rides on, and a back slope 26*a*' of the cam portion 26*a* engages with a lever pin 25*a* formed projecting on the lever 25. The OFF state of the changeover position detection switch 27 is maintained by such engagement of the cam portion 26*a* of the actuating member 26.

The changeover position detection switch 27 changes over the operation from the operation of the swing motor 11 to the operation of the slide motor 14 and vice versa, such that, when the changeover position detection switch 27 is turned ON or OFF, the slide motor 14 or the swing motor 11 is in operation, respectively. According to the present invention, when the position of the changeover position detection switch 27 is switched over, there exists a state in which the swing motor 11 and the slide motor 14 are in operation simultaneously, as will be explained later.

When the changeover position detection switch 27 is turned OFF, the swing motor 11 is run into operation, whereby the ball screw rod 7 is rotated in a pre-set direction, and the nut 6 is moved towards the left in FIG. 1 for thrusting the swing arm 2, whereby the swing arm 2 is rotated clockwise about the pivotal point on the bracket 1. This causes the slide door 21 to be moved towards the inside of the vehicle coming to completely close the slide door 21.

FIGS. 8 to 11 show timing charts during opening and closure of the slide door. Referring first to the timing chart of FIG. 8 for closing the slide door, if the changeover detection switch 27 is ON, that is if the lever 25 is not thrust such that the slide door 21 is open, an actuating switch for starting the slide door 21 is actuated to start the slide motor 14 for moving the slide door 21 forwards. Thereby the actuating member 26 is caused to abut against the engagement member 24 at a pre-set position near the end of sliding operation, with the changeover position detection switch 27 being changed over from the ON state to the OFF state.

An overlap period is provided during which the slide motor 14 and the swing motor 11 are simultaneously in operation after the changeover position detection switch 27 is turned off. Thus the slide motor 14 is kept in operation to maintain the thrust state of the lever 25 until the swing motor 11 is actuated to effect secured rotation of the swing arms 2, 2*a*. After start of rotation of the swing arms 2, 2*a*, the lever 25 remains thrust by the cam surface 26*a* of the actuating member 26 engaged with the lever pin 25*a*, as shown in FIG. 7.

By the provision of such overlap period, it becomes possible to absorb any fluctuations in the ON/OFF operation of the changeover position detection switch 27 without strictly setting the changeover position of the changeover position detection switch 27, in order to effect secured and smooth transition between the period of high-speed slide movement and the period of low-speed swing movement.

Figure 8:
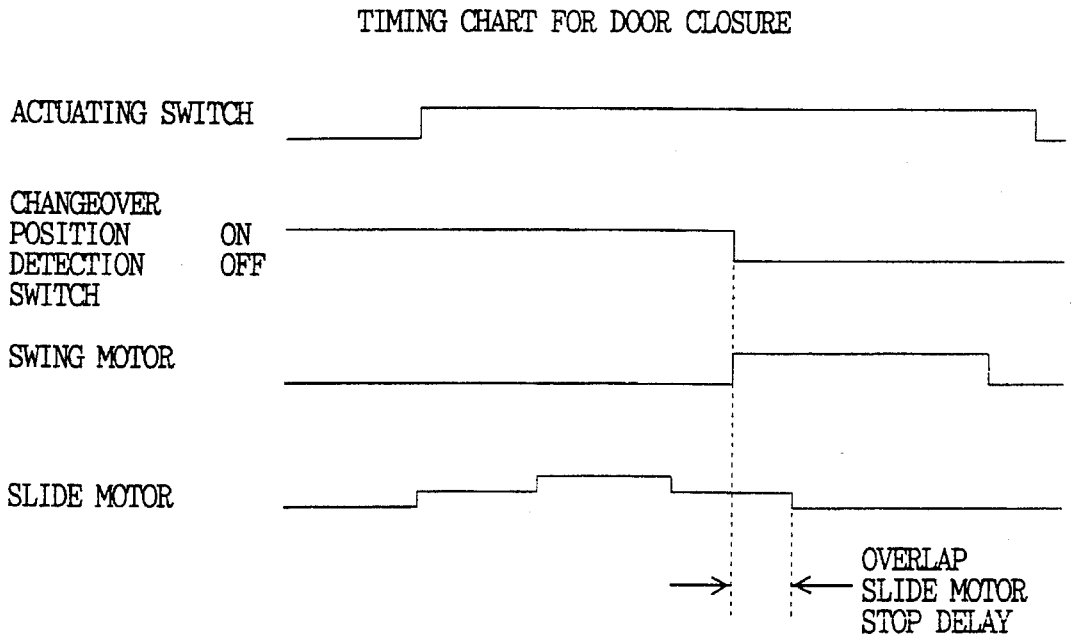
FIG. 8 is a timing chart for slide door closure according to a first embodiment.
Figure 12:
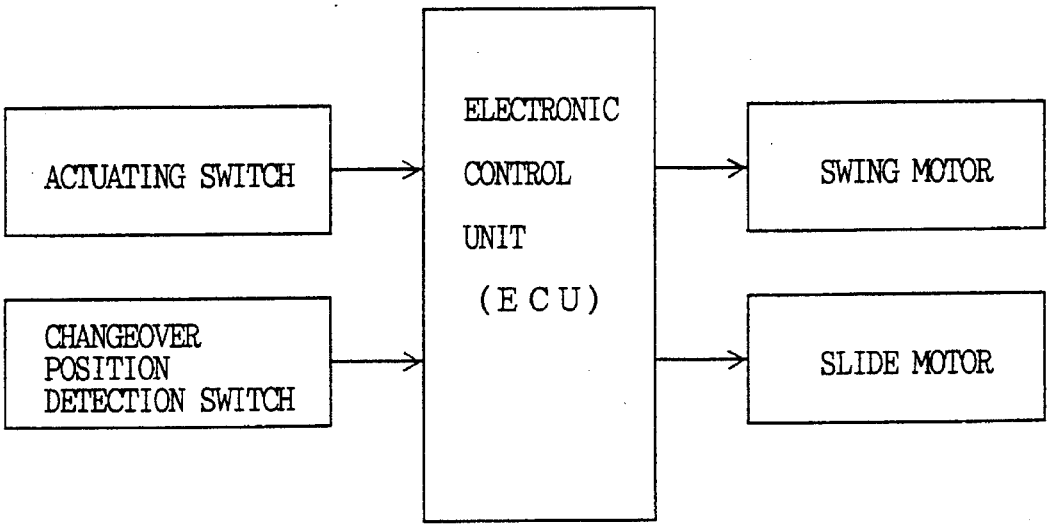
FIG. 12 is a block diagram showing control unit according to the present invention.
Figure 13:
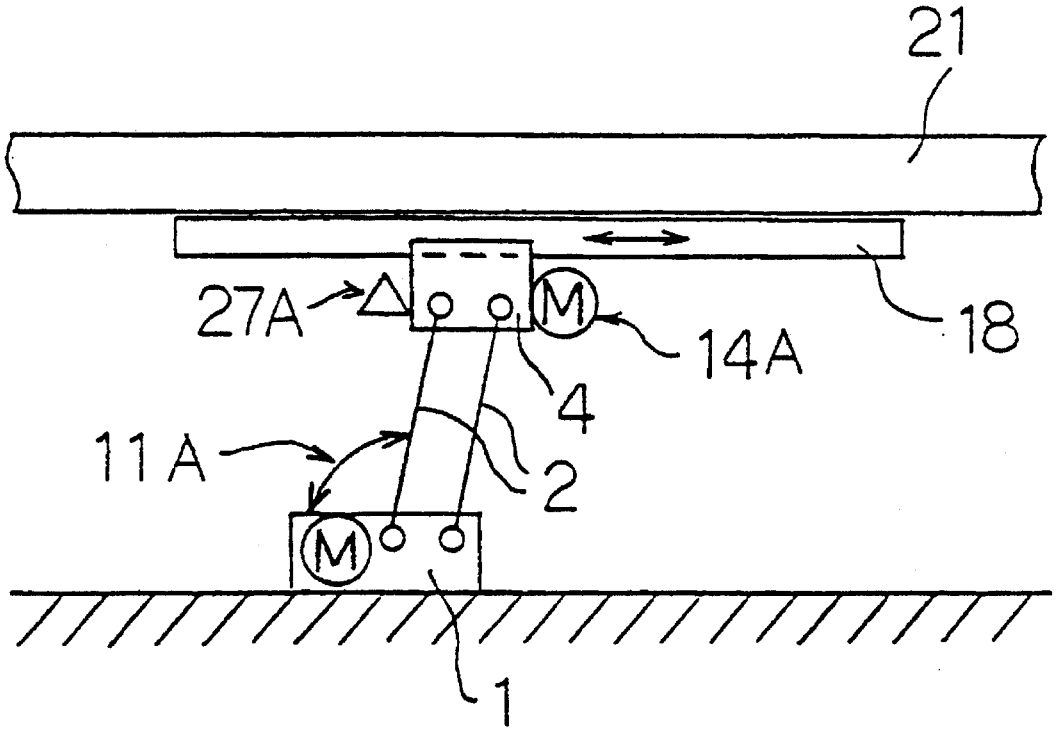
FIG. 13 is a schematic skeletonic view showing the basic structure of the present invention.
Figure 14:
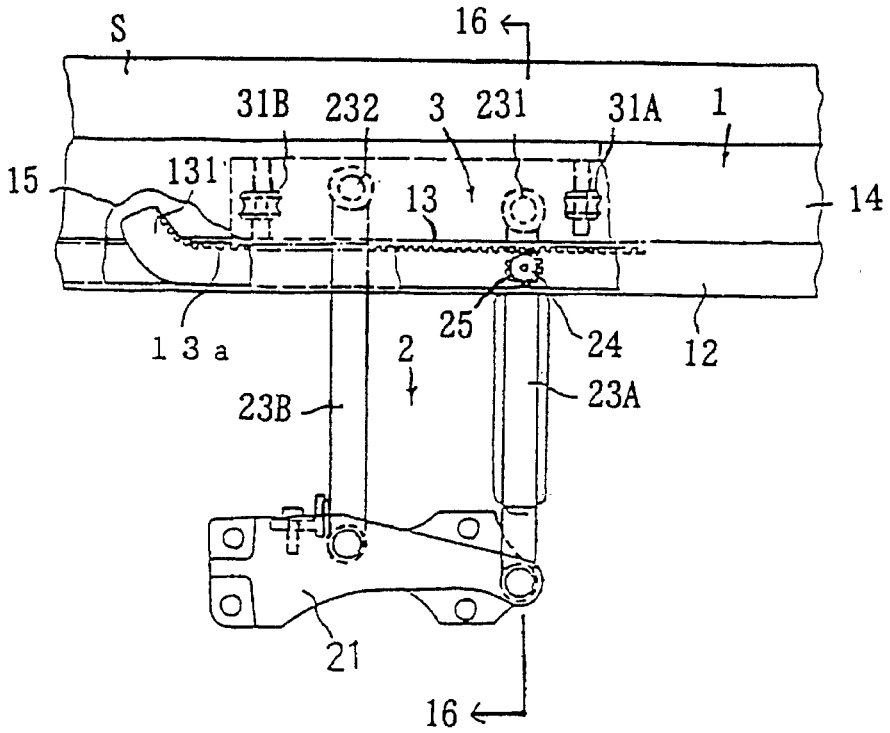
Fig. 14 PRIOR ART
FIG. 14 is a plan view showing an opened state of a conventional slide door device, with portions thereof being broken away.
Figure 15:
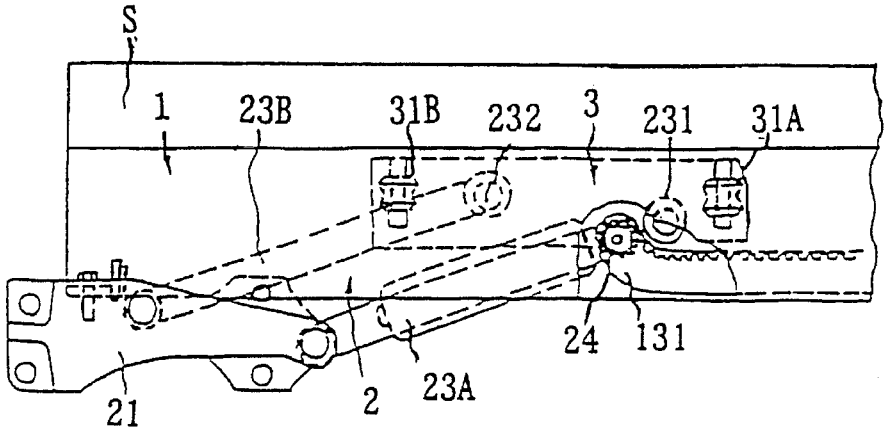
Fig. 15 PRIOR ART
FIG. 15 is a plan view showing a closed state of a conventional slide door device, with portions thereof being broken away.
Figure 16:
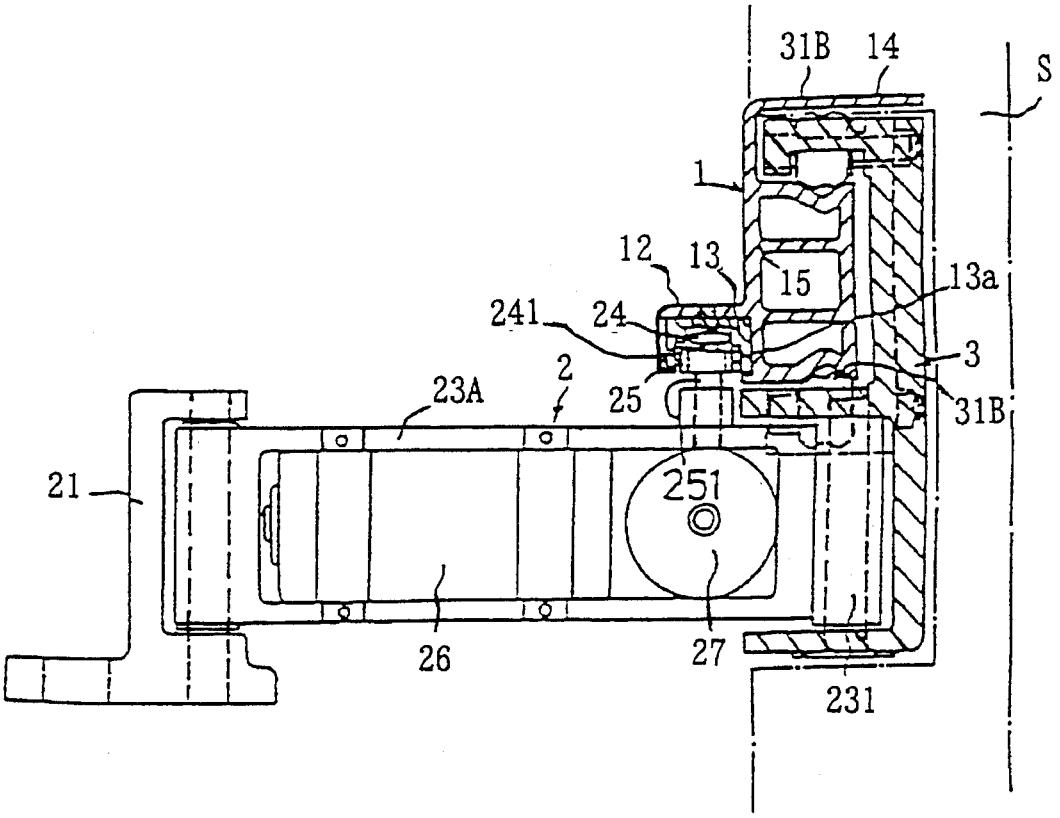
Fig. 16 PRIOR ART
FIG. 16 is a cross-sectional view taken along line 16—16 in FIG. 14.

Referring to the block diagram of the control unit in the present invention, shown in FIG. 12, a pre-set timer value in electronic control circuit unit (ECU) is set as an overlap period. The sliding speed of the slide door 21 can be variable, for instance, in 2-stepwise fashion of high and low speeds, as shown in FIG. 8, having a high speed range at the mid portion. The sliding speed can be changed, e.g., by switches 32, 33 for changing-over the sliding speed which run along a rail cam 31 disposed on one side of the slide rail 18. This will provide a more speedy opening/closing of the door.

Figure 9:
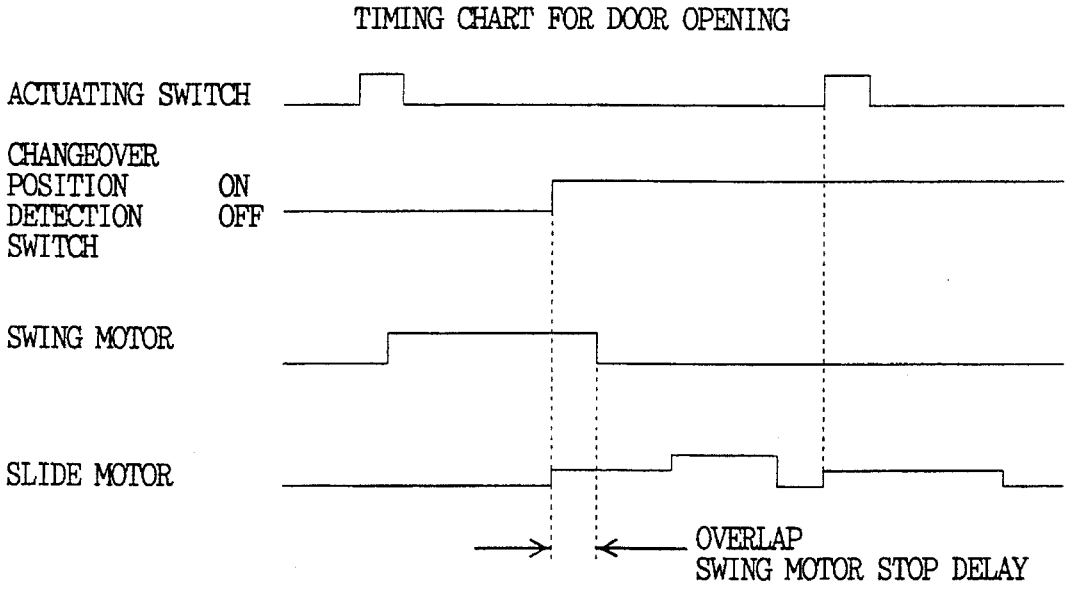
FIG. 9 is a timing chart for slide door opening according to a first embodiment.

FIG. 9 is a timing chart showing a first embodiment when the slide door is opened. An overlap period is provided during switching, as in FIG. 8.

Figure 10:
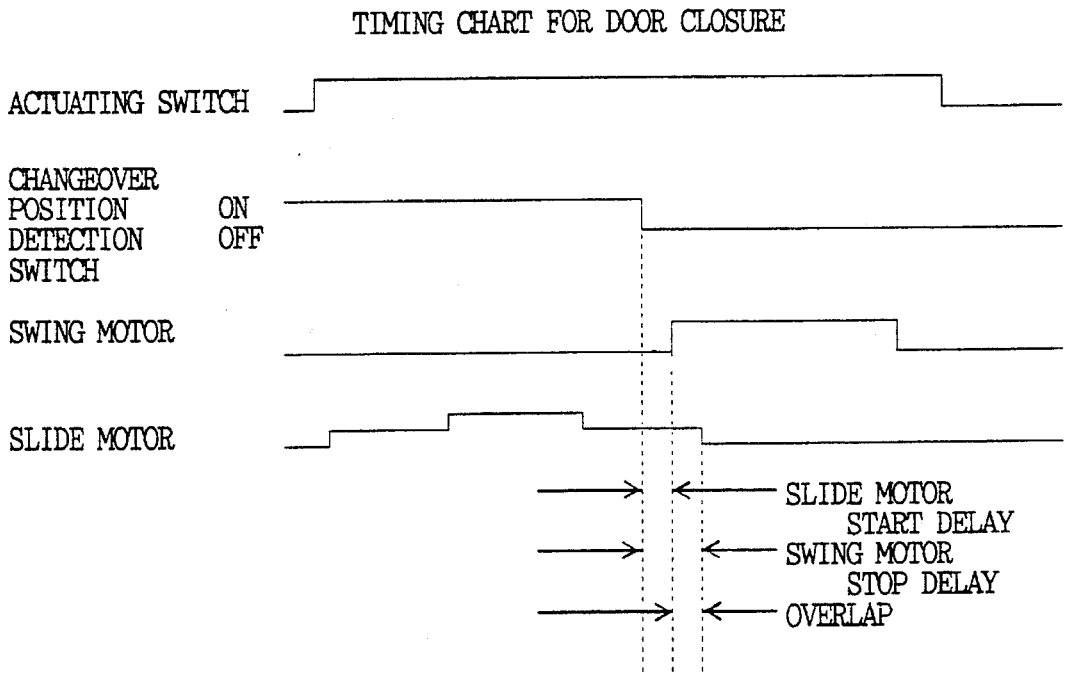
FIG. 10 is a timing chart for slide door closure according to a second embodiment.
Figure 11:
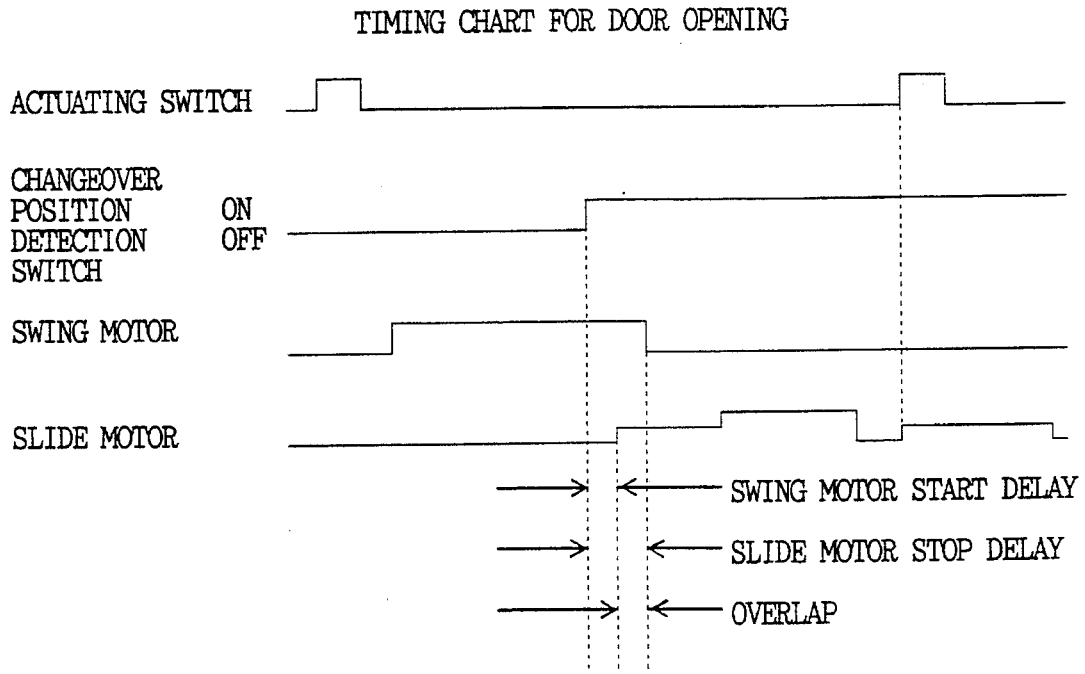
FIG. 11 is a timing chart for slide door opening according to a second embodiment.

FIGS. 10 and 11 are timing charts illustrating a second embodiment for closing and opening a slide door, respectively. For closing the slide door, shown in FIG. 10, the swing motor 11 is not started immediately after position switching over of the changeover position detection switch 27, but is started after a delay period, whereas the slide motor 14 is stopped after lapse of an overlap period. Thus a certain allowance may be provided as to accuracy in the assembly position in assembling the changeover position detection switch 27 in order to assure a more reliable operation of the slide door 21. Such delay period and overlap period are similarly provided during the opening of the slide door shown in FIG. 11.

It should be noted that any modification may be done without departing from the gist and scope of the present invention herein disclosed and claimed as appended.

What is claimed is:

1. An automatic slide door comprising (a) a slide rail secured to a slide door of a vehicle and extended in a fore-and-aft direction of the vehicle, (b) a slide rail guide holding said slide rail and held by an arm rotatably coupled to a main body of the vehicle, (c) a swing driving actuator for rotating said arm towards inside or outside of the vehicle, and (d) a slide driving actuator separate from said swing driving actuator said slide driving actuator being retained by said slide rail guide and being adapted for actuating said slide door and the slide rail in the fore-and-aft direction of the vehicle.

2. The automatic slide door as defined in claim 1, further comprising a control unit for simultaneously actuating said slide driving actuator and the swing driving actuator for a pre-set time responsive to an output signal of said relative position detector.

3. The automatic slide door as defined in claim 1, wherein said swing driving actuator comprises a screw rod assembly operating between said arm and a bracket to be secured to the main body of the vehicle for rotatably supporting said arm.

4. The automatic slide door as defined in claim 1, wherein said slide rail driving actuator comprises a motor-driven roll driving the slide rail.

5. The automatic slide door as defined in claim 1, wherein said swing driving actuator is adapted for being operative between a bracket rotatably coupling said arm to the vehicle and said arm pivotally supported on said bracket, and causes swinging movement of said arm, and wherein said slide rail is adapted for being moved only in the fore-and-aft direction with respect to said slide rail guide.

6. The automatic slide door as defined in claim 5, wherein said swing driving actuator and the slide driving actuator comprise a relative position detector operated between said slide rail and the slide rail guide, said swing driving actuator and said slide driving actuator being driven by an output signal of said relative position detector.

7. The automatic slide door as defined in claim 6, wherein said relative position detector includes a switch for detecting a changeover position at which switching is to be made between rotation of said arm and actuation of said slide rail, and a cam arrangement for holding an operating state of said switch.

8. The automatic slide door as defined in claim 7, wherein said cam arrangement comprises a first lever which is engageable with a cam disposed at a distal end of the arm to latch the open state of the door at a predetermined angle, said first lever being retained at a predetermined position defining the open state of the door by means of a spring force.

9. The automatic slide door as defined in claim 8, wherein said first lever is retained at said predetermined position defining the open state of the door by a second lever which is mounted on the slide rail guide and which is urged by a spring to prevent unlatching of the open state of the door.

10. The automatic slide door as defined in claim 9, wherein said second lever is associated with said switch for detecting a changeover position.

11. The automatic slide door as defined in claim 10, wherein at least one of said first and second levers is unlatched by an actuating member disposed on the slide rail to render the arm rotatable relative to the slide rail guide.

12. The automatic slide door as defined in claim 11, wherein said at least one of the first and second levers is unlatched when the slide rail is slid to an end position ready for rotating the arm for closing the door.

13. The automatic slide door as defined in claim 11, wherein said switch serves as the relative position detector.

14. The automatic slide door as defined in claim 13, wherein said switch is switched over upon abutment of the actuating member against the first lever.

15. The automatic slide door as defined in claim 14, wherein said second lever is an L-shaped lever that is mounted for swinging movement about a rotation center of the L-shaped lever, said L-shaped lever having a first leg for abutting said first lever and a second leg for engaging a cam surface of said actuating member disposed on the slide rail so as to retain the angular position of the slide rail relative to the slide rail guide during the rotation of the arm for closing and opening the door.

16. The automatic slide door as defined in claim 15, including a pin protruding from the second leg, said pin engaging a back-slope of the cam surface of said actuating member to retain the cam at the engaged position, when the actuating member urges the L-shaped lever to swing about its rotation center.

17. The automatic slide door as defined in claim 16, wherein said L-shaped lever is urged by a spring toward a direction for retaining the first lever to a locking position against the cam of the arm.

18. An automatic slide door comprising (a) a slide rail secured to a slide door of a vehicle and extended in a fore-and-aft direction of the vehicle, (b) a slide rail guide holding said slide rail and held by an arm rotatably coupled to a main body of the vehicle, (c) a swing driving actuator for rotating said arm towards the inside or outside of the vehicle, (d) a slide driving actuator held by said slide rail guide and adapted for actuating said slide door and the slide rail in the fore-and-aft direction of the vehicle, (e) a relative position detector including a switch for detecting a changeover position at which switching is to be made between rotation of said arm and the actuation of said slide rail, and a cam arrangement for holding an operating state of said switch, and (f) a control unit controlling the operation of said swing driving actuator and the slide driving actuator responsive to an output detection signal of said relative position detector, said control unit causing simultaneous operation of said swing driving actuator and the slide driving actuator for a pre-set time on detection of said output signal.

19. The automatic slide door as defined in claim 18, wherein the simultaneous operation of the swing and slide driving actuators is controlled by said switch, and including a lever which serves to retain the angular position between said arm and the door.

20. The automatic slide door as defined in claim 19, wherein said switch acts on a second lever which is urged by a spring toward the open state of the door, said second lever retaining the first lever which is engageable with a cam disposed on the arm.

21. The automatic slide door as defined in claim 18, wherein said pre-set time of simultaneous operation is initiated with a delay time after the detection of said output signal of the relative position detector.

* * * * *